United States Patent [19]

Yamamoto et al.

[11] 4,165,961

[45] Aug. 28, 1979

[54] BURNER WITH ULTRASONIC VIBRATOR

[75] Inventors: Katsuhiko Yamamoto, Nabari; Makoto Hori, Ikoma; Takaaki Nobue, Nara, all of Japan

[73] Assignee: Matsushita Electric Industrial Co., Ltd., Osaka, Japan

[21] Appl. No.: 837,553

[22] Filed: Sep. 28, 1977

[30] Foreign Application Priority Data

Sep. 29, 1976 [JP] Japan ..... 51-117765

[51] Int. Cl.[2] ..... 431 114; F23C 3/02

[52] U.S. Cl. ..... 431/1; 239/102

[58] Field of Search ..... 431/1, 114; 239/102, 239/4; 310/8.7, 9.1

[56] References Cited

U.S. PATENT DOCUMENTS

| | | | |
|---|---|---|---|
| 4,009,988 | 3/1977 | Duperow et al. | 431/114 |
| 4,081,233 | 3/1978 | Kitajima et al. | 431/1 |

*Primary Examiner*—Edward G. Favors

*Attorney, Agent, or Firm*—Burgess, Ryan and Wayne

[57] ABSTRACT

A burner with an ultrasonic vibrator wherein a plurality of electrostrictive vibrator elements are clamped between a front metal plenum having an atomizing surface formed at the leading end thereof and a rear metal plenum; an intermediate supporting member is joined to said front or rear metal plenum in proximity to one of said vibrator elements most closest thereto; the intermediate supporting member is in turn supported by a supporting member; means is provided for supplying a liquid fuel to the atomizing surface; and means for feeding the combustion air in front of the atomizing surface, whereby no undesired load is added to the vibration system; the atomizing surface is subjected to stable ultrasonic vibration and consequently the atomized fuel particles may be well mixed with combustion air.

2 Claims, 33 Drawing Figures

BURNER WITH ULTRASONIC VIBRATOR

BACKGROUND OF THE INVENTION

The present invention relates to a burner with a Langevin type ultrasonic vibrator including piezo-electric vibration elements.

There have been proposed a wide variety of supporting arrangements for supporting an ultrasonic vibrator assembly on a burner, and typical examples are:

(1) the arrangement wherein projections or brackets are formed integral with a front metal plenum in a vertical plane including a node spaced apart by a three-quarter wavelength from one end of the front metal plenum to which is bonded a vibrator element, the projections or brackets in turn being joined to a supporting member or housing of a burner;

(2) the arrangement in which a plurality of recesses are formed in the peripheral surface of a front metal plenum in the vicinity of a node thereof spaced apart by a three-quarter wavelength from one end thereof to which is bonded an electrostrictive vibrator element, and a plurality of supporting rods are extended from a supporting member or housing of a burner and inserted into the recesses;

(3) the arrangement in which a plurality of projections are formed integral with a front metal plenum in the proximity of a nodal position thereof, and are joined to a housing of a burner;

(4) the arrangement wherein a rear metal plenum is equal in length to a front metal plenum and is formed with a plurality of recesses in the peripheral surface thereof in proximity of a nodal position thereof, and a plurality of supporting rods are extended from a housing or the like of a burner and inserted into these recesses; and (5) the arrangement in which disks are fitted over front and rear metal plenums at their nodal positions and joined with each other with bolts and nuts. The assembly thus made is supported on a housing or the like of a burner.

The ultrasonic vibrator assemblies of the types described are subjected not only to the axial vibration but also to the radial vibration, and both the axial and radial vibrations are inevitably transmitted to supporting members. Therefore unless the vibrator assembly is supported by suitable means, the load on the vibrator assembly increases, resulting in decrease in efficiency of the transmission of vibration to an atomizing surface. Furthermore keen noise in the audible frequency range is generated from the joints between the vibrator assembly and the housing. Especially with the supporting arrangements described in (2) and (4) above, the supporting rods must be pressed against the bottoms of the recesses under considerable forces so that the load on the vibration system further increases and keen metal-to-metal contact noise is further pronounced. Moreover with the prior art supporting arrangements, the assembly of a vibrator assembly on a housing or the disassembly thereof from the housing is difficult. That is, they are not adapted for mass production and simple maintenance and repairs or replacement.

SUMMARY OF THE INVENTION

One of the objects of the present invention is therefore to provide an arrangement for supporting an ultrasonic vibrator assembly on a housing of a burner without adversely increasing the load on the vibration system of the burner.

Another object of the present invention is to provide a burner which may substantially eliminate noise from the joints between the vibrator assembly and the housing or the supporting member and which is simple in construction and is consequently adapted for mass production at less cost.

A further object of the present invention is to standardize and unify the components associated with the vibrator assembly so that the assembly of these parts may be accomplished in a simple manner yet with a higher degree of dimensional accuracy and the disassembly thereof may be also facilitated.

A further object of the present invention is to stabilize the atomization of liquid fuel, thereby increasing the efficiency of the burner.

DESCRIPTION OF THE PREFERRED EMBODIMENTS

Figure 1:
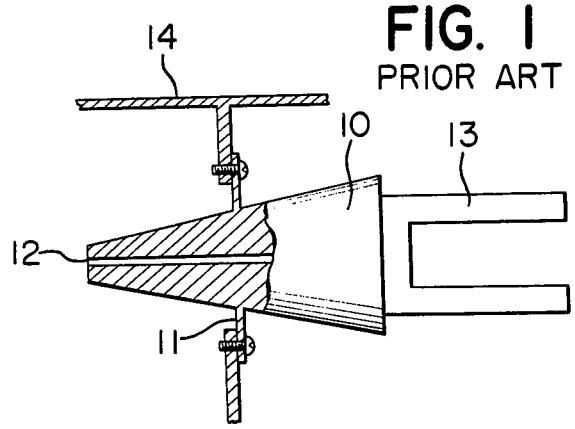
FIG. 1 PRIOR ART
FIGS. 1–5 are sectional views, partly in section, of prior art supporting arrangements.

In FIGS. 1–5 there are shown typical prior art supports of a vibrator of a burner. In the arrangement shown in FIG. 1, a magnetostriction vibrator 13 is securely bonded with an adhesive to one end of a front metal plenum 10, and projections or brackets 11 which are formed integral with the front metal plenum 10 in a plane containing the nodal position of no displacement at a three-quarter wavelength between the vibrator 13 and an atomizing surface 12 of the front metal plenum 10 are joined to and supported by a housing or a main body 14.

Figure 2:
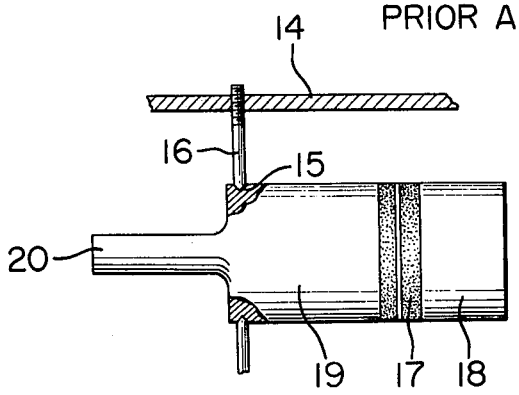
FIG. 2 PRIOR ART

In the arrangement shown in FIG. 2, an electrostrictive vibrator 17 is sandwiched between a front metal plenum and a rear metal plenum 18, and a plurality of supporting rods 16 which are extended from the main body 14 are fitted into recesses 15 formed in the peripheral surface of the front plenum 19 in proximity of the nodal position of a three-quarter wavelength, whereby the vibrator is supported. A reference number 20 is an atomizing surface.

Figure 3:
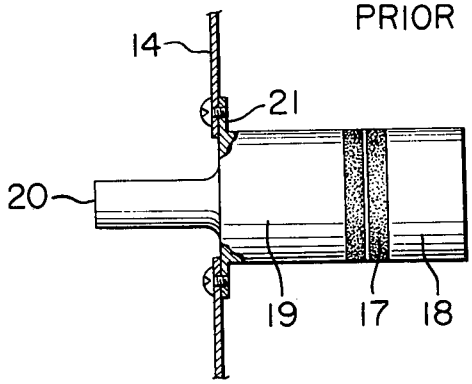
FIG. 3 PRIOR ART

In the supporting arrangement shown in FIG. 3, a plurality of projections or brackets 21 are formed integral with the front metal plenum substantially in a plane containing the nodal position and joined to the main body 14.

Figure 4:
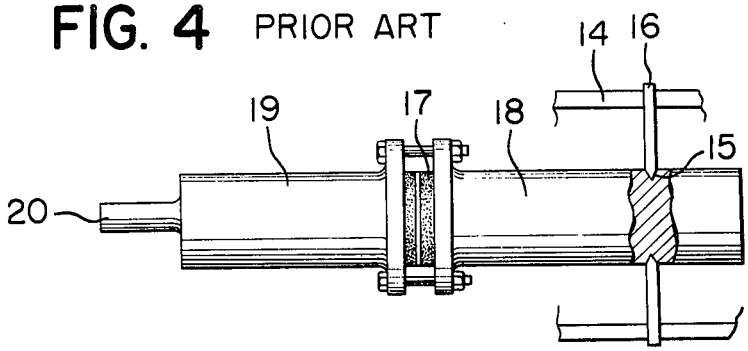
FIG. 4 PRIOR ART

In the arrangement shown in FIG. 4, a plurality of supporting rods 16 extended from the main body 14 are fitted into the recesses 15 formed in the peripheral surface of the rear metal plenum in the proximity of a nodal position. Thus the construction is substantially similar to that shown in FIG. 2 except that the rear plenum is equal in length to the front metal plenum 19.

Figure 5:
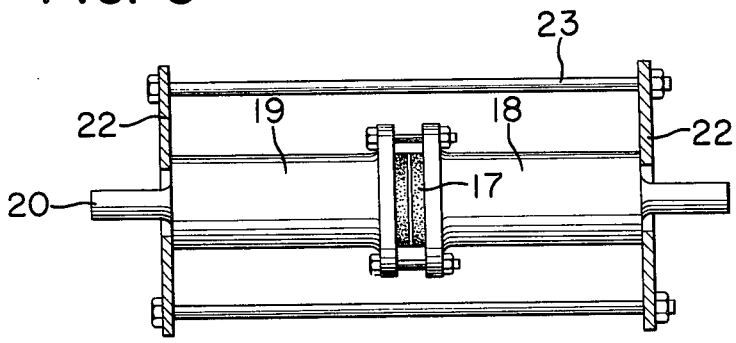
FIG. 5 PRIOR ART

In the arrangement shown in FIG. 5, disks 22 are attached to the front and rear metal plenums 19 and 18 at nodal positions thereof and are joined to each other with bolts 23.

Figure 6:
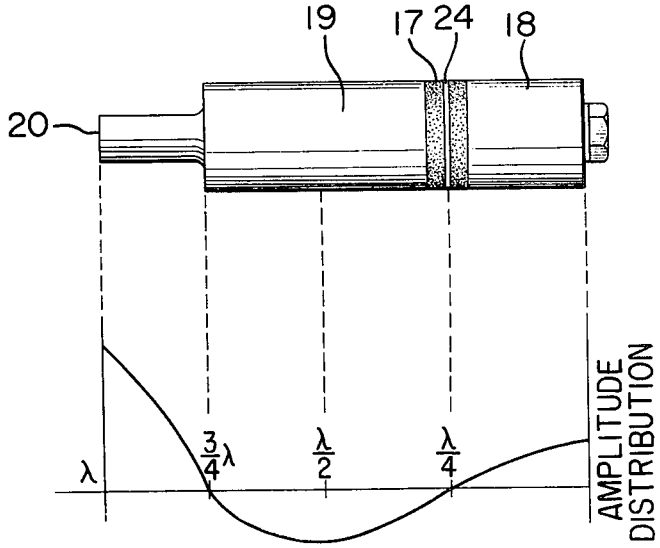
FIG. 6 PRIOR ART
FIGS. 6 and 7 are diagrams used for the explanation of the problems of these prior art supporting arrangements.
Figure 7:
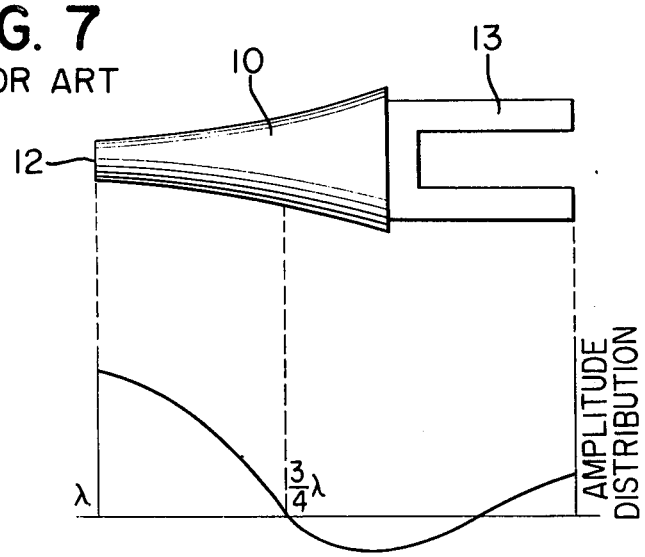
FIG. 7 PRIOR ART

The prior art supports described above, however, have the following problems:

(1) The ultrasonic waves are propagated as shown in FIG. 6 or 7. In FIG. 6, the nodal positions are a point corresponding to one-quarter of wavelength; that is, the point at which the electrode 24 is sandwiched between the vibrators 17 and a point corresponding to a three-quarter of wavelength. Since these nodal positions are theoretically points and because a certain width is required in order to support the vibrator assembly at a point corresponding to a three-quarter of wavelength, the propagation of ultrasonic waves to the supporting members cannot be avoided. In addition, the nodal positions tend to displace themselves depending upon the environmental temperature, the variation in characteristics of the vibrator, the loading condition and so on.

The amplitude is suddenly increased from the node of a three-quarter wavelength to the atomizing surface 20. Therefore when the node or the supporting point is displaced into this range, the transmission of vibration to the supporting members increases and acts as an undesired load so that efficiency drops and keen noise in the audible frequency range is generated. Thus it is not preferable to support the vibrator assembly at the node of a three-quarter wavelength.

On the other hand, the node at a point in the electrode 24 sandwiched between the vibrators 17 will not displace itself even when the resonance frequency changes so that the amplitude in the proximity of this node is small and constant. Therefore it is preferable to support the vibrator assembly at this nodal position. It is ideal to support the electrode 24 itself, but in practice it is impossible to do so because of the problems of strength, isolation and so on. Thus there exist some problems even in the Langevin type ultrasonic generator.

FIG. 7 shows the amplitude distribution of the magnetostriction ultrasonic vibrator assembly using a ferrite element. When the vibrator assembly is supported at the nodal position in the front metal plenum 10, the problems similar to those described above arise. In addition, since the nodal position of a one-quarter wavelength exsists in the vibrator 13 itself, the vibrator cannot be supported.

(2) The supporting arrangement shown in FIG. 1 requires the projections or brackets 11 which must be formed integral with the front metal plenum so that the fabrication is difficult and the cost is high.

(3) In the supporting arrangement shown in FIG. 2, the supporting rods 16 are fitted into the recesses 15 formed in the front metal plenum 19. The supporting rods 16 must be forced against the bottoms of the recesses 15 so that the load on the vibration system increases and noise is generated because of the vibration between the supporting rods 16 and the recesses 15.

(4) In the supporting arrangement shown in FIG. 3, the amplitude distribution is substantially similar to that shown in FIG. 6 so that the problems described in (1) arise.

(5) The supporting arrangement shown in FIG. 4 has the same problems as the arrangement shown in FIG. 2. Furthermore, the distance between the supporting position and the atomizing surface 20 becomes longer so that the dimensional errors increase in assembly.

(6) In the arrangement shown in FIG. 5, the disks 22 at the nodal positions are joined to each other by the bolts and nuts 23 so that the load on the vibration system increases because of the reasons described in (1).

(7) With the vibrator assemblies of the types described, the vibrations occur both in the axial and radial directions, and the transmission of these axial and radial vibrations to the supporting members cannot be avoided. Therefore when a suitable supporting method is not employed, the load on the vibrator or vibrators increases, resulting in decrease in efficiency for transmitting the ultrasonic vibration to the atomizing surface. Furthermore, keen noise in the audible frequency range is generated at the joints between the vibrator assembly and the supporting members.

(8) With the prior art supporting arrangements, the assembly to and disassembly from the main body of the vibrator assembly are difficult. Furthermore they are not adapted for mass production and result in poor serviceability.

(9) In the prior art burners with an ultrasonic vibrator, one end of a fuel pipe is directly joined to the front metal plenum so that the vibration is transmitted from the front metal plenum to the fuel pipe, increasing the load on the vibration system. Furthermore keen noise is generated at the joint between the other end of the fuel pipe and the main body.

(10) In the burners including the vibrator assemblies of the types described, ignition failure tends to occur very frequently unless the positional relationship between the atomizing surface 20 or 12 and two ignition electrodes. Since the behavior of fuel particles atomized by the ultrasonic energy is extremely unstable, the precise adjustment of the positions of the ignition electrodes relative to the atomizing surface is essential. With the prior art burners with an ultrasonic vibrator, the positions of the electrodes relative to the atomizing surface are very frequently displaced when the ultrasonic vibrator assembly is assembled on and removed from the main body.

DESCRIPTION OF THE PREFERRED EMBODIMENTS

First Embodiment, FIGS. 8–15

The present invention was made to overcome the above and other problems encountered in the prior art burners with an ultrasonic vibrator, and will become apparent from the following description of preferred embodiments thereof taken in conjunction with the accompanying drawings.

First, referring to FIGS. 8–15, a burner with a Langevin type ultrasonic vibrator will be described. Reference numeral 25 denotes an outer casing or shell in which is disposed an inner cylinder 26 so as to define an air passage 27. Mounted on this outer casing 25 is a blower 31 comprising a motor 28, rotary blades 29 and an air suction port 30 for forcing swirling air into the air passage 27. An air control body 32 is disposed at the leading end of the air passage in order to streamline the secondary air and to increase the swirling forces. This air control body 32 has a plurality of blades 33 (See FIG. 14). The outer casing 25 is connected to a combustion cylinder 34. The inner cylinder 26 is formed with a plurality of holes 35 in communication with the air passage 27 so that the primary air may be supplied through these holes 35. 36 is an ultrasonic vibrator assembly comprising two piezo-electric vibrators 37, an electrode 38, a front metal plenum 39 and a rear metal plenum 44. The electrode 38 is sandwiched between the piezo-electric vibrators 37, and the assembly consisting of the electrode 38 and the vibrators 37 is in turn sandwiched between the front and rear metal plenums 39 and 44 and tightened with bolts 45, washers 46 and nuts 47 under a constant torque (See FIGS. 18 and 19). An atomizing face 40 is formed at the leading end of the front metal plenum 39 which is formed with a liquid passage 41. The front metal plenum 39 is formed with a flange 43 in the proximity of the vibrator 37, and the flange 43 is formed with a plurality of holes 42 (See FIG. 9). 48 is an annular intermediate supporting member which is joined to projections 49 of the annular intermediate supporting member 48. In assembly, fitted over the pin 50 extended from the projection 49 are a washer 53, the flange 43 of the front metal plenum 39, a resilient member 54 made of rubber or the like and a washer 55 in the order named. Thus the vibrator assembly 36 and the intermediate supporting member 48 is provided as a unit. 51 is a tape hole drilled through the projection 49 of the intermediate supporting member 48.

Figure 11:
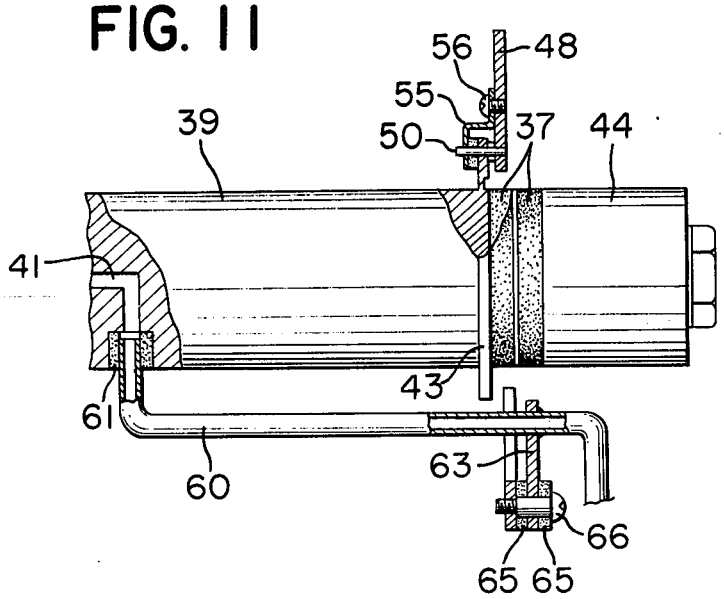
FIG. 11 is a side view, partly in section, showing the joint between an oil passage in a front metal plenum and a fuel supply pipe.
Figure 12:
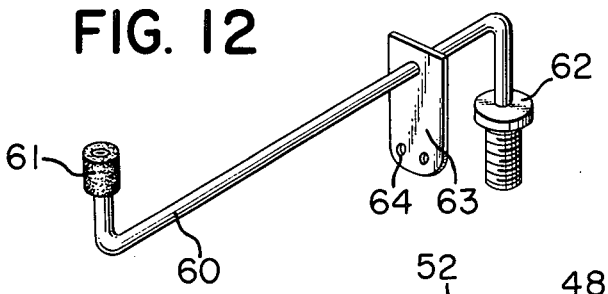
FIG. 12 is a perspective view of the fuel supply pipe.
Figure 13:
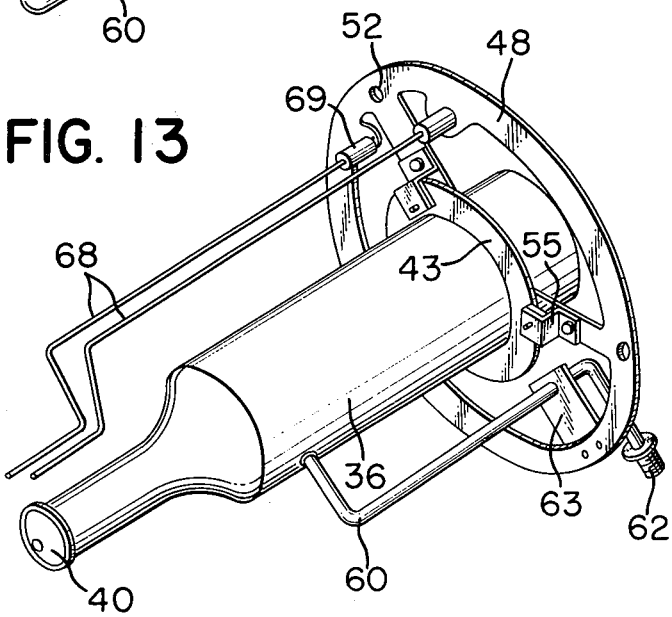
FIG. 13 is a perspective view of the vibrator assembly assembled with the fuel supply pipe, the intermediate supporting member and two ignition electrodes.
Figure 14:
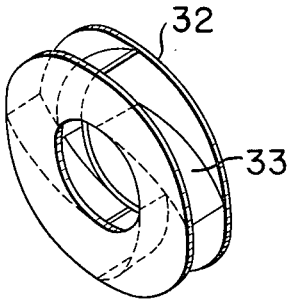
FIG. 14 is a perspective view of an air control member.
Figure 15:
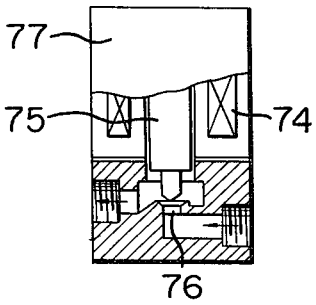
FIG. 15 is a side view, partly in section, of a solenoid-operated valve inserted in a fuel supply line.

The intermediate supporting member 48 is joined to the inner cylinder 26 with washers 57, resilient members 58 and screws 59 (See FIG. 10). 28 is a hole formed in the intermediate supporting member 48 for mounting the screw 59. 60 is a pipe one end of which is bonded through a vibration isolator 61 made of rubber or the like to the liquid passage 41 in the front metal plenum 39 (See FIGS. 11 and 12). The other end of the pipe 60 is welded to a connection joint 62 which is securely held to the inner cylinder 26 with a nut 67. A supporting plate 63 is fitted over the pipe 60 at a point between its ends and is joined through a vibration isolator 65 to the intermediate supporting member 48 with a screw 66. 64 is a mounting hole formed through the supporting plate 63.

68 denotes two electrodes, one ends of which are positioned adjacent to the atomizing surface at the leading end of the front metal plenum 39 and the other ends of which are securely held through an insulator 69 to the intermediate supporting member 48. Therefore, the ultrasonic vibrator assembly 36, the pipe 60 and the ignition electrodes 68 are all mounted on the intermediate supporting member 48 and are therefore unified.

70 is a cover provided with a flame detector 71 and an inspection window 72. 71 is a fuel storage tank containing kerosene or light oil. 77 is a solenoid-operated valve (See FIG. 15) comprising a solenoid 74, a movable shaft 75 and a valve 76. One end of a conduit pipe 78 is joined to the joint 62 of the pipe 60 with a flare nut 79, and the other end of the conduit pipe 78 is joined to the solenoid-operated valve 77. The conduit pipe 80 intercommunicates between the solenoid-operated valve 77 and the fuel tank 73. 81 denotes a flame.

Figure 16:
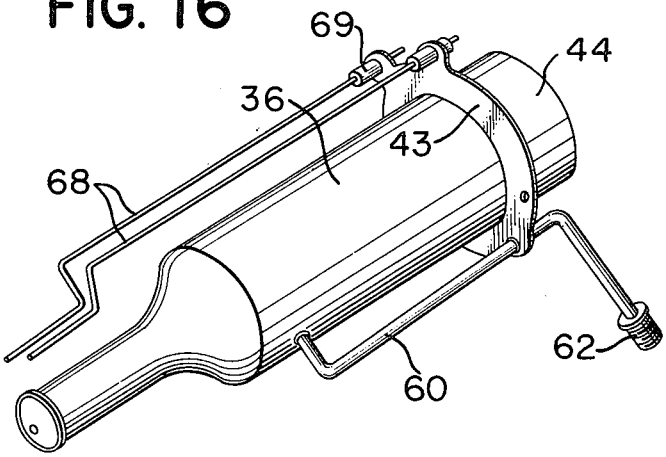
FIG. 16 is a modiciation of an ultrasonic vibrator assembly together with its associated parts.
Figure 17:
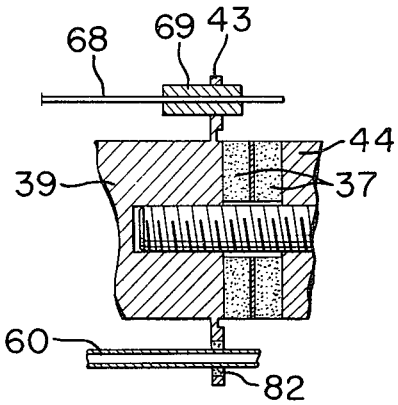

Second Embodiment, FIGS. 16 and 17

Referring to FIGS. 16 and 17, the pipe 60 is securely bonded through a vibration isolator 82 made of rubber or the like to the flange 43 of the front metal plenum 39. The ignition electrodes 68 are mounted on the flange 43 with insulators 69. Thus the front metal plenum 39, the pipe 60 and the ignition electrodes 68 are provided as a unit.

Referring to FIGS. 18–26, various modifications are shown of the flange 43 of the front metal plenum 39. First referring to FIG. 18, the flange is formed integral with the front metal plenum 39 adjacent to the vibrator 37 and is formed with a plurality of holes 42. The portion of the flange 43 adjacent to the root thereof is reduced in thickness as shown at 43*a* so that the transmission of vibration may be minimized.

Figure 19:
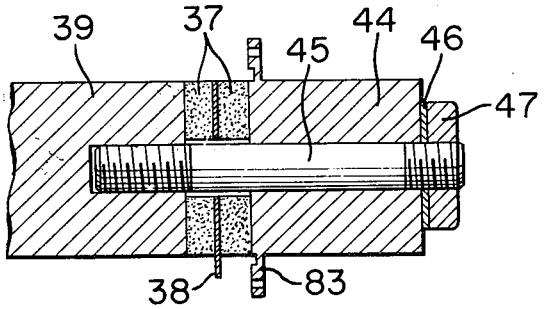

In FIG. 19, a flange 83 is formed integral with the rear metal plenum 44 adjacent to the vibrator 37.

Figure 20:
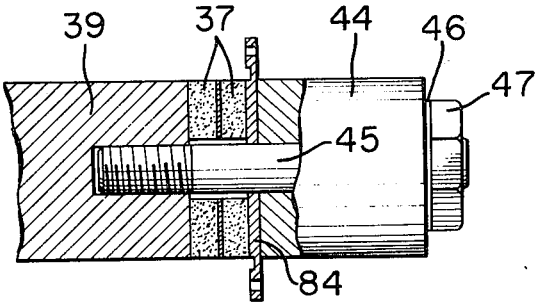

In FIG. 20, a flange 84 plate is formed as a separate unit and is sandwiched between the vibrator 37 and the rear metal plenum 44. Alternatively, the flange plate 84 may be interposed between the vibrator 37 and the front metal plenum 39.

Figure 21:
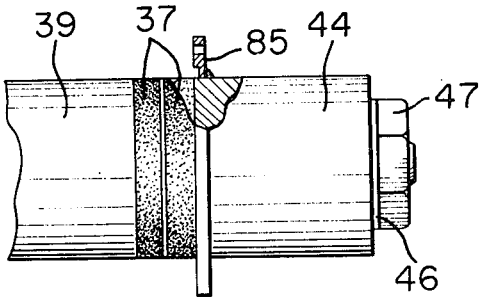

In FIG. 21, a flange 85 is formed as a separate unit and is joined to by welding or fitted into the rear metal plenum adjacent to the vibrator 37. Alternatively, the flange 85 may be joined to the front metal plenum 39 adjacent to the vibrator 37. The flange 85 may be made of a metal or plastic.

Figure 22:
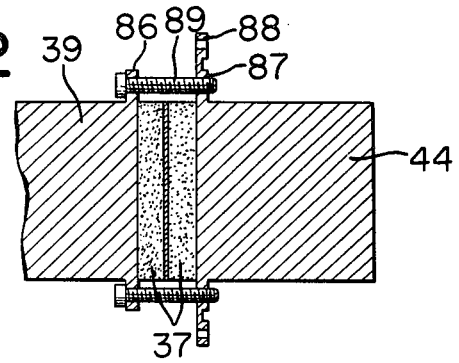

In FIG. 22, protrusions 86 and 87 are formed integral with the front and rear metal plenums 39 and 44, respectively, and joined to each other with bolts 89 and nuts in order to securely hold the vibrators 37 therebetween. A mounting flange 88 is formed integral with the protrusion 87 in order to joint the vibrator assembly to the intermediate supporting member 48. The flange 88 may be formed integral with the protrusion 86 on the front plenum 39.

Figure 23:
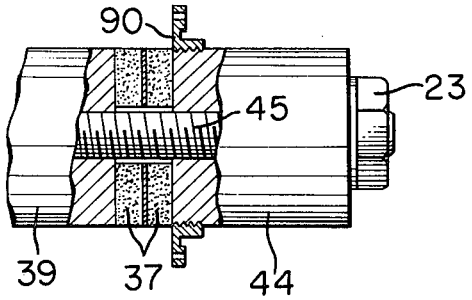

In FIG. 23, a flange 90 is made of a metal or plastic and screwed on the rear or front metal plenum 44 or 39 adjacent to the vibrator 37.

Figure 24:
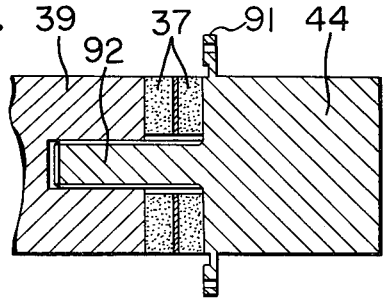

In the arrangement shown in FIG. 24, a flange 91 and a bolt 92 are formed integral with the rear metal plenum 44. The bolt 92 is screwed into the front metal plenum 39.

Figure 25:
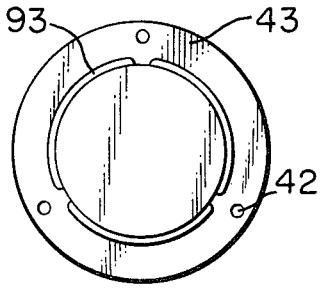
Figure 26:
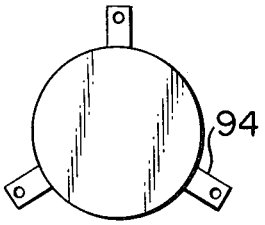

In the modification shown in FIG. 25, the flange 43 is formed with a plurality of arcuate grooves so that a plurality of arcuate slits 69 may be defined between the flange 43 and the front or rear metal plenum 39 or 44 when the former is mounted on the latter. In the arrangement shown in FIG. 26, flange is divided into a plurality of segments 94.

Figure 27:
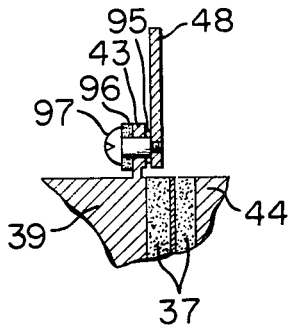

In the modification shown in FIG. 27, a small washer 95 is interposed between the flange 43 and the intermediate supporting member 48, and a vibration isolator 96 is interposed between the flange 43 and a screw 97. These components are tightly joined with each other when the screw 97 is tightened.

Figure 28:
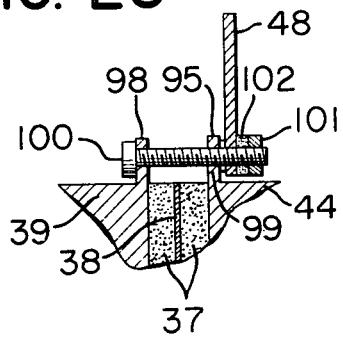

In the arrangement shown in FIG. 28, protrusions 98 and 99 are formed integral with the front and rear metal plenums 39 and 44 and joined to each other with bolts 100. A washer 101 is interposed between the protrusion 99 and the intermediate supporting member 48 and a vibration isolator 102 made of rubber or the like is interposed between the intermediate supporting member 48 and a nut 101.

Figure 29:
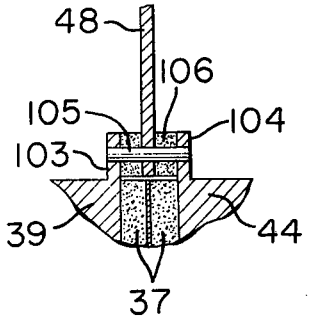

In FIG. 29, flanges 103 and 104 are formed integral with the front and rear metal plenums 39 and 44, respectively, and the intermediate supporting mmember 48 and vibration isolators 106 are securely held between the flanges 103 and 104 by pins 105 extended therebetween.

Figure 30:
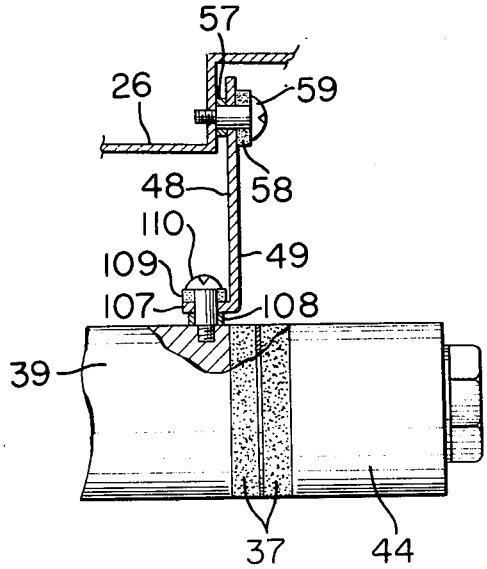
Figure 31:
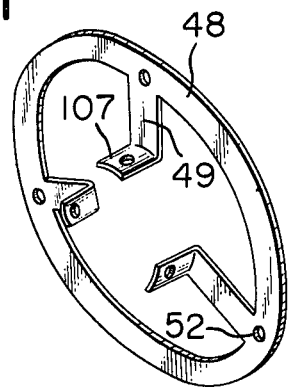

In the modification shown in FIGS. 30 and 31, a projection 107 of the projection 49 of the intermediate supporting member or ring 48 is securely held with a screw 86 to the peripheral surface of the front metal plenum 39 adjacent to the vibrator 37, and a vibration isolator 108 made of rubber or the like is interposed between the projection 107 and the front plenum 39 while a vibration isolator 109 made of rubber or the like is interposed between the projection 107 and the head of the screw 110.

Figure 32:
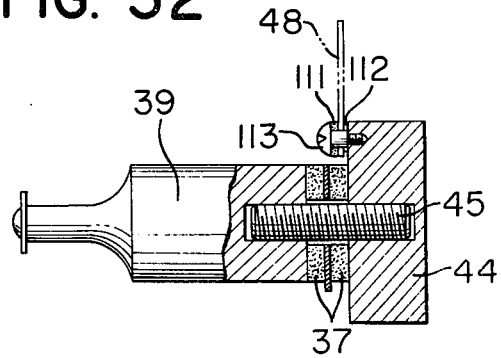
Figure 33:
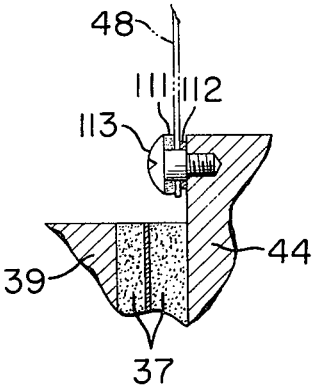

In the arrangement shown in FIGS. 32 and 33, the rear metal plenum 44 is increased in diameter greater than the vibrator 37, and the intermediate supporting member 48 is joined to the front end face of the rear metal plenum 44 with screws 107. Vibration isolators 111 and 112 are interposed between the heads of the screws 113 and the intermediate supporting member 48 and between the intermediate supporting member 48 and the rear metal plenum 44.

Alternatively, the diameter of the front metal plenum 39 may be made greater than the diameter of the vibrator 37 so that the intermediate supporting member 48 may be attached to the rear end face of the front metal plenum 39 in a manner substantially similar to that described above.

Next referring back to FIG. 8, the mode of operation will be described. A high-frequency power is applied from an ultrasonic generator (not shown) to the vibrators 37 so that the latter may vibrate in the directions of their thickness at a predetermined resonant frequency between 28 and 50 KHz. Vibration which has been magnified by the front metal plenum 39 is transmitted to the atomizing surface 40 so that the latter vibrates at an ultrasonic frequency. The motor 28 is energized to rotate the blades 29 for forcing the air into the air passage 27. Therefore the air swirling air flows are injected through the air control member 32 into the combustion cylinder 34. The air is also forced through the holes 35 formed through the inner cylinder 26 to cool the ultrasonic vibrator assembly 36 and to flow forward.

A voltage of the order of about 10 KV is applied from a transformer to the pair of ignition electrodes 68 so as to generate a spark in proximity of the atomizing surface 40.

Thereafter the solenoid-operated valve 87 is energized to open the valve 76 for feeding the liquid fuel to the atomizing surface 40. The liquid fuel is atomized on the atomizing surface 16 into finely divided particles and ignited by the spark generated between the two electrodes 68. As a result, the atomized liquid fuel mixed with the air burns and forms the flange 81 in the combustion cylinder 34. The burner is used as a heat source of a hot water boiler or the like.

The problems of the prior art supporting arrangements of the ultrasonic vibrator assembly have been described in detail elsewhere, and these problems may be substantially overcome by the following effects, features and advantages of the present invention.

(1) The burner with a Langevin type ultrasonic vibrator of the type wherein the vibrator elements are interposed between the front and rear metal plenums is characterized in that the vibrator assembly is supported in the vicinity of one of these vibrator elements.

The prior art supports of the ultrasonic vibrator assembly are shown in FIGS. 1–5 and their problems have been described above. As readily seen from FIG. 6, the amplitude of vibration of the front or rear metal plenum 39 or 44 at a point adjacent to the vibrator is relatively low, and the node at a point in the electrode sandwiched between the two vibrators will not be displaced by the change in load on the vibration system so that the amplitude of vibration at a point in proximity of the vibrator will not change and is always constant. Furthermore the increase in load on the vibration system due to the supporting of the vibrator assembly at the position in proximity of the vibrator is negligible in practice. In addition, the transmission of vibration to the supporting members may be minimized so that noise suppression may be easily attained. With the prior art supporting arrangements, the internal stress due to vibration becomes maximum at the nodal position corresponding to a point spaced away from the rear end of the rear metal plenum by a three-quarter of wavelength. However, the internal stress are less in the vicinity of the vibrator. Therefore the fundamental arrangement of the supporting members in accordance with the present invention is preferable.

The intermediate supporting member is attached to the front or rear metal plenum in the vicinity of the vibrator so that the intermediate supporting member and the front or rear metal plenum may be provided as a unit. The vibrator assembly is supported through the intermediate supporting member to the main body of the burner. As a result, the flange formed integral with the front or rear metal plenum may be reduced in size and may be easily machined or otherwise formed in a simple manner with a resultant reduction in cost. Furthermore the flange may be eliminated and the intermediate supporting member may be directly joined to the front or rear metal plenum adjacent to the vibrator.

(2) Since the flange is formed integral with the front or rear metal plenum, the positioning and joint of the vibrator assembly to the intermediate supporting member may be much facilitated. Furthermore the flange may be machined or otherwise formed with an extremely higher degree of accuracy so that the variation in dimensional error of the assembled vibrator assembly may be minimized.

(3) The vibrators not only resonate in the longitudinal (axial) direction but also vibrate more or less in the transverse (radial) direction, and both the axial and radial vibrations are transmitted to the flange formed integral with the front or rear metal plenum.

Figure 18:
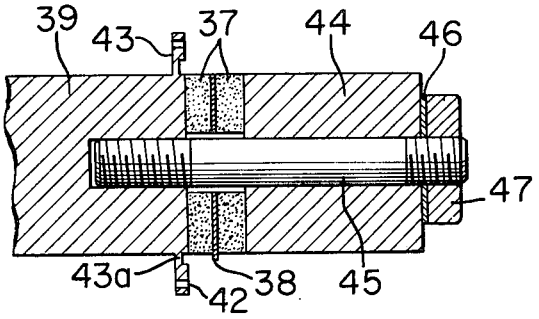
FIGS. 18–33 are views used for the explanation of various arrangements in accordance with the present invention for joining the ultrasonic vibrator assembly to the intermediate supporting member.

According to one embodiment of the present invention, the portion close to the root of the flange is reduced in thickness to 0.5 to 1 mm as shown in FIGS. 18 and 19 while the remaining wall thickness of the flange is 1.5 to 2.5 mm. As a consequence, the transmission of vibration to the outer portion of the flange may be minimized, but there arises no problem of strength of the flange. Same is true for the arrangement shown in FIG. 25 wherein a plurality of slits or holes are defined between the flange and the front or rear metal plenum.

(4) As shown in FIG. 20, the flange may be separately formed and interposed between the vibrator and the front or rear metal plenum. The intermediate supporting member may be attached to this separate flange in a manner substantially similar to that in which the intermediate supporting member is attached to the flange integral with the front or rear metal plenum. The flange may be mass produced by simple machining steps.

Furthermore the separate flange may be securely joined to the front or rear metal plenum by welding or with an adhesive as shown in FIG. 21. Alternatively, the flange may be screwed onto the front or rear metal plenum as shown in FIG. 23. The separate flange may be made of a metal or plastic. When the flange made of plastic is used, noise at the joints between the intermediate supporting member and the flange may be easily suppressed.

(5) In the arrangement shown in FIG. 22, the flanges formed integral with the front and rear metal plenums are securely joined to each other with the bolts and nuts in order to securely hold the vibrators between the front and rear metal plenums. The intermediate supporting member may be joined to either of the flange on the front or rear metal plenum. As a result, as compared with the prior art supporting arrangements, the ultrasonic vibrator assembly may be made compact in size and may be supported in a simplified manner.

(6) In the arrangement shown in FIG. 29, the opposed flanges are formed integral with the front and rear metal plenums so that the intermediate supporting member may be clamped therebetween without the use of screws or the like.

(7) The intermediate supporting member is in the form of a ring and is formed with a plurality of radially inwardly extended projections which are in turn joined to the front or rear metal plenum or to the flange thereof. As a result, the transmission of vibration to the projections may be minimized. Furthermore, the flame condition may be detected or observed through the spaces between the projections from the rear of the burner. Moreover the air may be permitted to freely flow through these spaces so that the ultrasonic vibrator assembly as well as the rear metal plenum may be efficiently cooled.

Figure 9:
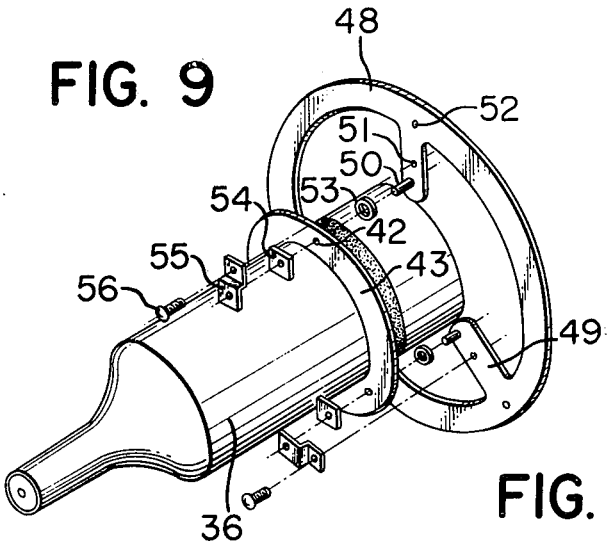
FIG. 9 is an exploded perspective view of a vibrator assembly thereof.
Figure 10:
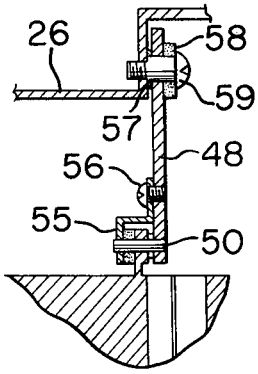
FIG. 10 is a fragmentary sectional view, on enlarged scale, thereof showing in detail the joint between an intermediate supporting assembly and the vibrator assembly.
Figure 8:
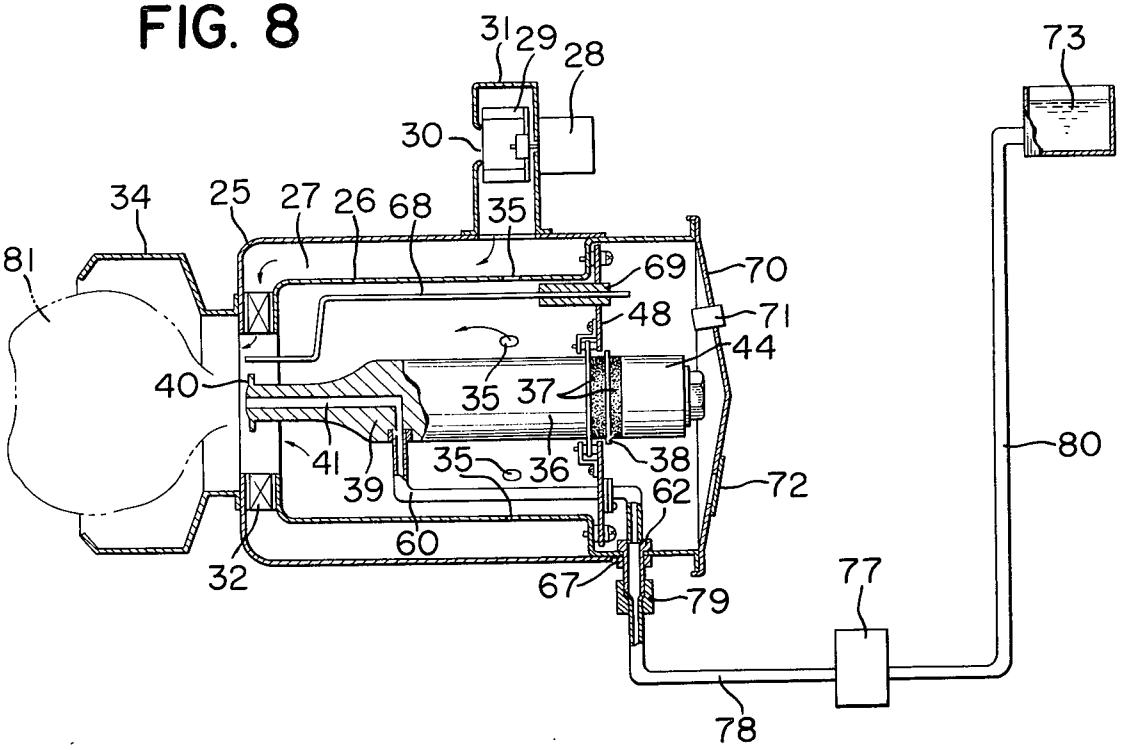
FIG. 8 is a sectional view of a first embodiment of a burner with a Lagevin type ultrasonic vibrator in accordance with the present invention.

(8) As shown in FIG. 9, the pin is axially inwardly extended from the projection of the annular flange, and the flange is joined with the bolts and nuts to the flange formed integral with the front or rear metal plenum. The washers are interposed between the projection and the flange and between the flange and the retainer. Therefore the ultrasonic vibrator assembly and the intermediate supporting member may be assembled with a higher degree of dimensional accuracy, and the assembly or disassembly thereof may be much facilitated.

(9) The vibration isolators made of a resilient material such as rubber may be interposed between the flange and the projections so that the noise due to the contact between them may be easily suppressed. Furthermore, prior to assembly the vibration isolators are compressed under a predetermined force so that the flange and the projections may be joined together with constant forces.

(10 ) According to the present invention, the holes formed through the flange or the surface of the flange may be coated with a film of plastic so that the noise due to the contact between the intermediate supporting member and the flange or between the pins of the intermediate supporting member and the holes of the flange which receive the pins may be considerably suppressed.

(11) The intermediate supporting member may be made of a metal sheet coated with plastic or made of a plastic so that the noise at the contact between the intermediate supporting member on the one hand and the ultrasonic vibrator assembly or other parts of the burner on the other hand may be considerably suppressed.

(12) Washers and/or vibration isolators small in size may be interposed between the intermediate supporting member and the ultrasonic vibrator assembly so that the transmission of vibration from the ultrasonic vibrator assembly to the intermediate supporting member may be minimized. Furthermore they may be also interposed between the intermediate supporting member and other parts of the burner so that the further transmission of vobration to other parts of the burner may be also minimized.

(13) Means for damping the transmission of vibration are interposed between the joints between the intermediate member and the vibrator assembly and between the intermediate member and other parts of the burner so that the vibration of the burner itself may be minimized and the stable operation of the ultrasonic vibrator assembly may be ensured.

(14) Screws made of plastic or screws coated with plastic may be used for joining the intermediate supporting member on the one hand and the vibrator assembly and other parts of the burner on the other hand so that noise at the joints may be also minimized.

(15) When the pipe is joined with an adhesive to the liquid fuel passage in the front metal plenum and to the outer casing with the joint and nut and when the vibrator assembly is mounted in the outer casing or removed therefrom, the pipe is bent or the joint to the liquid fuel passage is damaged due to the torsional and bending forces. Furthermore the vibration characteristics of the vibrator assembly may be adversely affected.

However according to the present invention a point of the pipe between its ends is supported by the intermediate supporting member which in turn supports the vibrator assembly. As a result, the ultrasonic vibrator assembly, the intermediate supporting member and the pipe may be provided and handled as a unit so that the above described problems may be overcome.

(16) When the pipe has its one end directly joined with an adhesive to the liquid fuel passage in the front metal plenum, the transmission of vibration from the front metal plenum to the pipe increases so that noise may be generated at the other ends of the pipe and the load on the ultrasonic vibrator increases. However, according to the present invention, a vibration isolator is interposed between the pipe and the front metal plenum so that the transmission of vibration from the front metal plenum to the pipe may be minimized. Thus the problems encountered in the prior art supporting arrangements may overcome. Furthermore the vibration isolator may be interposed between the pipe and the intermediate supporting member so that the noise due to the contact therebetween may be sufficiently suppressed.

(17) The ignition electrodes are supported on the intermediate supporting member so that they and the ultrasonic vibrator assembly may be provided and handled as a unit. As a result, the positions of these electrodes to the atomizing surface of the front metal plenum may be always correctly maintained so that the positive and reliable ignition may be attained and the adhesion of oil to the electrodes may be minimized.

(18) In the arrangement shown in FIGS. 16 and 17, the pipe is supported on the flange so that the pipe and the ultrasonic vibrator assembly may be provided and handled as a unit so that the effects and advantages same with those described in (15) may be attained.

In addition, the vibration isolator may be interposed between the flange and the pipe so that the transmission of the vibration from the former to the latter may be minimized. Furthermore when the ignition electrodes are supported on the flange, the effects and advantages same with those described in (17) may be attained.

In summary, according to the present invention no undesired load is imparted to the vibration system including the Langevin type ultrasonic vibrator so that the atomizing surface at the leading end of the front metal plenum may vibrate in a reliable and dependable manner. Consequently, the stable and uniform atomization of the fuel may be ensured and excellent combustion efficiency may be attained. In addition, vibration noise may be substantially suppressed, and the burner maybe made simple in construction and well rationalized.

What is claimed is:

1. A burner comprising:

a burner casing;

an ultrasonic vibrator unit comprising two piezoelectric vibrator elements and an electrode plate disposed therebetween;

a front metal body having a liquid fuel passage therein with an inlet part and an exit aperture adjacent an atomizing surface thereof;

a rear metal body;

bolt and nut means for securing and clamping said vibrator unit between said metal bodies;

an intermediate supporting member;

means including a plurality of resilient members for securing an outer part of said intermediate supporting member to said casing and an inner part thereof to one of said metal bodies;

a fuel supply pipe;

a vibration isolator comprising resilient material for connecting said inlet part of said front metal body and one end of said pipe;

first resilient vibration isolation means for connecting another part of said pipe, remote from said end thereof, to said intermediate supporting member;

a pair of ignition electrodes;

second resilient vibration and electrical isolation means for connecting said electrodes to said intermediate supporting member;

means including said pipe and passage for feeding liquid fuel to said atomizing surface; and means for feeding air for combustion to said atomizing surface.

2. The burner according to claim 1, wherein said one metal body secured to said intermediate supporting member has an annular flange with an inner part adjacent said one metal body and an outer part secured to said flange through at least one of said resilient members, the thickness of said outer part being greater than the thickness of said inner part.

* * * * *

UNITED STATES PATENT AND TRADEMARK OFFICE

CERTIFICATE OF CORRECTION

PATENT NO. : 4,165,961

DATED : August 28, 1979

INVENTOR(S) : Katsuhiko Yamamoto, et al

It is certified that error appears in the above—identified patent and that said Letters Patent is hereby corrected as shown below:

Column 7, line 48: "air" (1st occurrence) should be cancelled.

Column 10, line 17: "vobration" should be --vibration--.

Signed and Sealed this

*Eighteenth* Day of *March 1980*

[SEAL]

*Attest:*

SIDNEY A. DIAMOND

*Attesting Officer*

*Commissioner of Patents and Trademarks*